US005806221A

United States Patent [19]

Vander Woude

[11] Patent Number: 5,806,221

[45] Date of Patent: Sep. 15, 1998

[54] DRIVE FOR A MULTI-SIDED DISPLAY SIGN

[76] Inventor: Loren L. Vander Woude, 16624 Grand Ave., Bellflower, Calif. 90706

[21] Appl. No.: 831,024

[22] Filed: Apr. 1, 1997

[51] Int. Cl.[6] ..... G09F 11/10

[52] U.S. Cl. ..... 40/503; 74/128

[58] Field of Search ..... 40/503, 504, 505, 40/506; 74/128

[56] References Cited

U.S. PATENT DOCUMENTS

| | | | |
|---|---|---|---|
| 1,221,758 | 4/1917 | Locke | 40/505 |
| 3,657,833 | 4/1972 | Vetter . | |
| 4,002,022 | 1/1977 | Lopez | 58/126 |
| 4,021,946 | 5/1977 | Bradshaw | 40/504 X |
| 5,161,421 | 11/1992 | Stigsson | 74/84 |
| 5,255,463 | 10/1993 | Werner | 40/505 |
| 5,255,465 | 10/1993 | Perez | 40/505 |
| 5,416,996 | 5/1995 | Clemens et al. | 40/502 |
| 5,483,765 | 1/1996 | Karsten et al. | 40/505 |
| 5,485,693 | 1/1996 | Frenken et al. | 40/505 |
| 5,511,330 | 4/1996 | Havens | 40/505 |

*Primary Examiner*—Cassandra H. Davis
*Attorney, Agent, or Firm*—Gene Scott—Patent Law & Venture Group

[57] ABSTRACT

A segmented sign drive provides rotational driving force from a drive arm moving in reciprocating motion. The arm moves a series of pins in a series of grooves located in drive disks. A drive disk is mounted to each segment of the sign so as to rotate the segments into preferred positions in a step-by-step sequence where all of the segments move together to new positions so as to change the outward appearance of the sign. The grooves are ramped so that on a forward stroke of the drive arm the pins are moved upward on a ramped groove in the drive disks to fall into a preferred hole at one end of each of the grooves. On the return or reverse stroke, the pins, now caught within the holes, cause the disks to rotate by one part of the cycle. On the next cycle, the pins again move out of the holes and up the ramp surfaces of the next grooves which have been moved into place where the former grooves were. In this manner, the disks are caused to rotate by an appropriate amount on each rotational cycle of a switch limited motor.

5 Claims, 3 Drawing Sheets

DRIVE FOR A MULTI-SIDED DISPLAY SIGN

BACKGROUND OF THE INVENTION

1. Field of the Invention

This invention relates generally to large display signs such a common billboards, and more particularly to a mechanical drive for a multi-sided billboard type sign, where the sign is segmented with each segment having multiple sides and where segment rotation is synchronized.

2. Description of Related Art

The following art defines the present state of this field:

Vetter, U.S. Pat. No. 3,657,833 describes a multiple-display sign device which is capable of displaying a plurality of individual presentation on an alignment to a viewer and, in its preferred embodiment, to do so on a plurality of alignments.

Lopez, U.S. Pat. No. 4,002,022 describes an electromechanical sign which alternatively exhibits two different kinds of information, for example clock or sign display information, on two respective faces of several adjacent dihedral angles.

Stigson, U.S. Pat. No. 5,161,421 describes a driving device for driving or operating elongate display members at signs for consecutive, repeated presentation of series of images, whereby said elongate display members are driven through pairs of gear wheels having conical teeth and whereby a driving gear wheel in each pair of gear wheels is provided on a drive shaft and a driven gear wheel in each pair is operatively connected with the elongate display member to be driven.

Werner, U.S. Pat. No. 5,255,463 describes a rotating sign assembly that includes a number of multisided, rotatable sign segments driven by an elongated drive shaft operably interconnected with each of the sign segments. The drive shaft includes at least one multi-armed driven cam fitted to the drive shaft.

Perez, U.S. Pat. No. 5,255,465 describes a multi-display sign assembly, which is particularly lightweight, may be hung in a variety of locations which could not normally support such a sign structure, and functions in smooth, quiet, and relatively low vibration movements, the sign assembly including a frame structure having a pair of support bars, and a plurality of elongate, lightweight triangular members rotatably held between the support bars by axle bars which extend longitudinally through the triangular members and protrude through the support bars.

Clemens et al., U.S. Pat. No. 5,416,996 describes a display apparatus for showing a number of different display images. The apparatus includes a housing and a plurality of triangular display elements mounted therein. Each of the display elements includes a first, second and third major sides, and is suspended for rotation about an axis, the axes of rotation of the elements arranged in a plane.

Karsten et al., U.S. Pat. No. 5,483,765 describes rectangular transparency panels that form the sides of triangular units that are lighted from within. A gear train drives the units in synchronism. A base housing has a plurality of parallel aligned round posts projecting upwardly from it.

Frenken et al., U.S. Pat. No. 5,485,693 describes a display device of the type having a plurality of parallel prisms that rotate intermittently and synchronously to present the surfaces of the different panels of each prism for view to provide different composite panels of each prism for view to provide different composite advertising designs.

Havens, U.S. Pat. No. 5,511,330 describes a transmission system for louver type signs wherein the signs consist of a plurality of multiple faced louvers having indicia defined thereon and the side-by-side relationship of the louvers permits pre-selected faces to define a completed image and simultaneous partial rotation of the louvers presents a new visible image, and wherein, each louver is operated by a separate "T" drive bevel gear transmission having an output shaft upon which a louver is mounted operatively connected to a drive shaft perpendicularly related to the output shaft.

The prior art teaches the use of multisided and mechanically driven segmented signs. However, the prior art does not teach a sign having a disk drive of the type described in the present invention, wherein a simple drive arm engages a set of drive disks for rotation so as to be inexpensive to produce, have long life and be readily assembled on site. The present invention fulfills these needs and provides further related advantages as described in the following summary.

SUMMARY OF THE INVENTION

The present invention teaches certain benefits in construction and use which give rise to the objectives described below.

The present invention provides a segmented sign drive having as series of drive disks engaged by a drive arm with engagement pins slidingly engaging the drive disks.

A primary objective of the present invention is to provide a simplified sign drive structure having advantages not taught by the prior art.

Another objective is to provide such a sign drive having the ability to be assembled quickly due to relatively few parts, having inexpensive parts as compared to those of the prior art which require gears and other parts of high complexity and manufacturing costs, and high reliability in operation due to a simple pin in groove operation.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
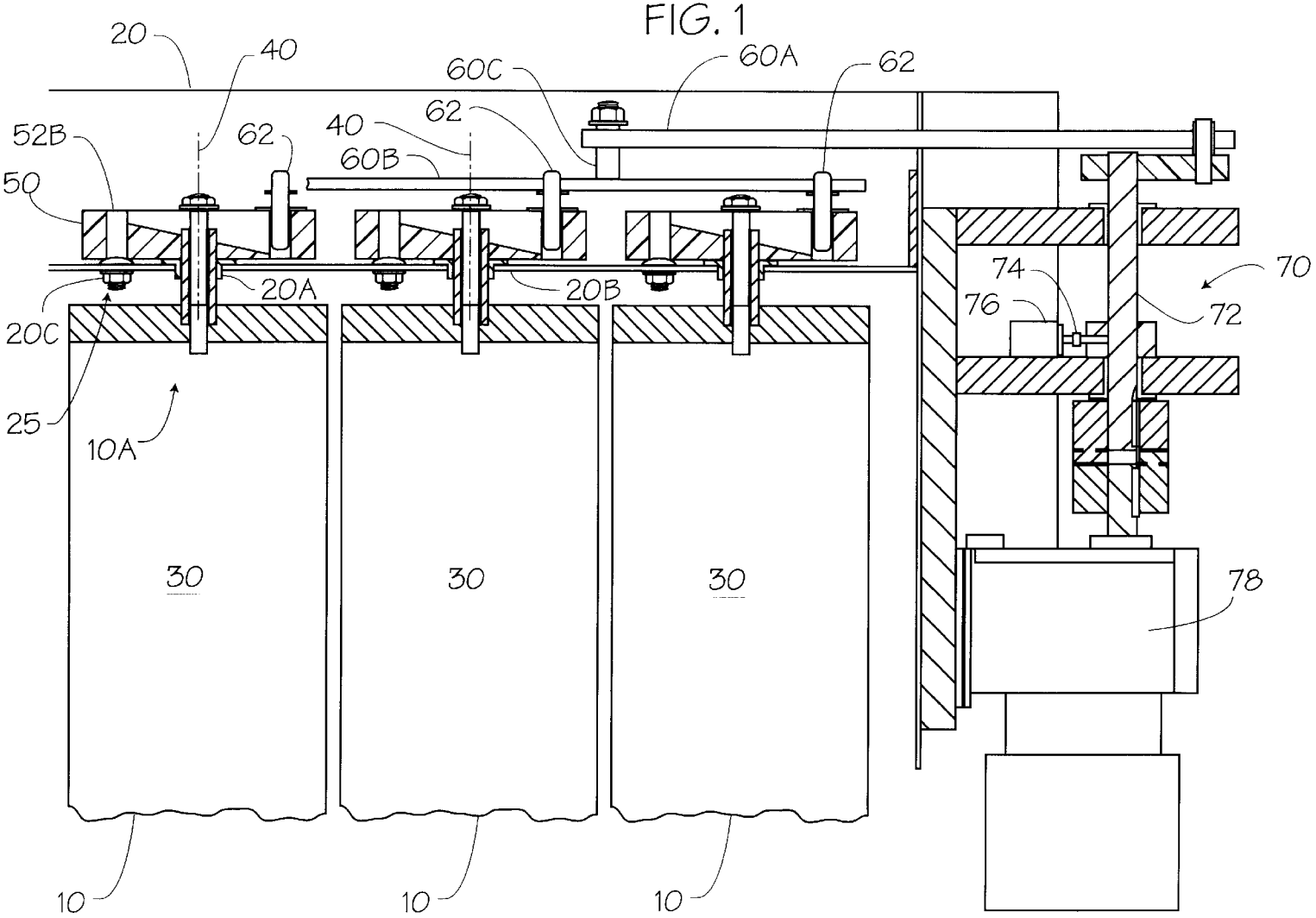
FIG. 1 is a sectional side elevational view of the preferred embodiment of the present invention.

The above described drawing figures illustrate the invention, a sign drive device. The device provides a plurality of side-by-side sign segments 10, preferably each having three sides as is shown in the patent to Perez, U.S. Pat. No. 5,255,465, which is incorporated herein by reference. The segments 10 are rotatably mounted on a fixed sign frame 20 by any means for axial rotational mounting well known in the art. Each of the segments 10 provides a plurality of sign sides 30, but preferably three sides, arranged symmetrically and rotatable about a rotational axis 40 of each segment 10, as shown in FIG. 1, for presenting each one of the sign sides 30, in turn, in a preferred orientation, i.e., directed to a point of viewing such as to a sidewalk or street. A drive disk 50 is rigidly engaged with each segment 10 at one end 10A of each of the segments 10 so as to rotate with it, and indeed drive it. The drive disks 50 each provide a plurality of interconnected grooves 52 in one surface 54 of each of the drive disks 50, each of the grooves 52 providing, at one end 52A of said groove 52 a pin rest cutout 52B, the grooves 52 each further providing a ramped surface 52C contiguous with the pin rest cutout 52B. In this manner, engagement pins 62 which move in the grooves 52 of the drive disks 50, are able to move easily from the pin rest cutout 52B in one direction of motion, but not able to move away from, or out of the pin rest cutout 52B in another direction of motion, as will be explained and shown. As seen in FIG. 1, each of the drive disks 50 preferably rests upon detent bolts 20C in a support shelf 20B. The detent bolts 20C preferably have round heads protruding in the direction of the drive disks 50 and are positioned for engagement with the pin rest cutouts 52B. As the drive disks 50 reach the preferred points in their rotation for positioning the sign segments 10, the pin rest cutouts 52B frictionally engage the round heads of the detent bolts 20C for assuring proper positioning of the drive disks 50. Therefore, the present invention is improved by providing a means for detent rotational location 25 comprising detent bolts 20C in cooperation with pin rest cutouts 52B.

As seen in FIGS. 1, 2A, 2B, and 3 a drive arm means 60 preferably including an upper drive arm 60A and a lower drive arm 60B act in cooperation and extend in proximity to the drive disks 50, the arm 60B providing a plurality of the engagement pins 62. The pins 62, as described, engage the grooves 52 of the drive disks 50 respectively as shown clearly in FIGS. 3 and 6. The pins 62 move in corresponding positions within the drive disks 50 such that, for each engagement pin 62 and corresponding drive disk 50, one of the pins 62 lies within a corresponding one of the pin rest cutouts 52B in the corresponding drive disk 50, reciprocal motion of the drive arm means 60 causing the engagement pins 62 to rotate the drive disks 50 from a first rotational position P1 (FIG. 2A) whereby one of the sign sides 30 of each of the segments 10 respectively is presented in the preferred direction, to a second rotational position P2 (FIG. 3) whereby another of the sign sides 30 of each of the segments 10 respectively is presented in the preferred direction. This enables the segments 10, together, to form a different composite image for each reciprocation of the drive arm means 60. Please note that the lower drive arm 60B moves vertically to accommodate motion of the engagement pins vertically. Arm 60A moves along shaft 60C for such accommodation.

Figure 2B:
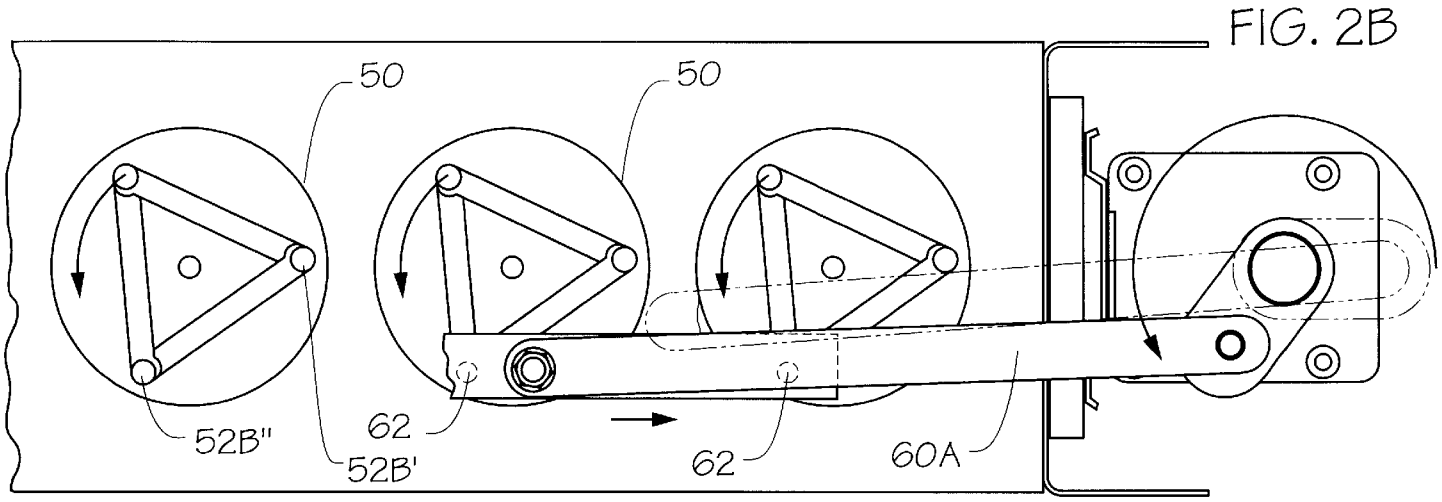
FIG. 2B is a top plan view thereof showing a drive arm of the invention moving in a reverse stroke of reciprocating motion of the invention and turning drive disks therewith.
Figure 2A:
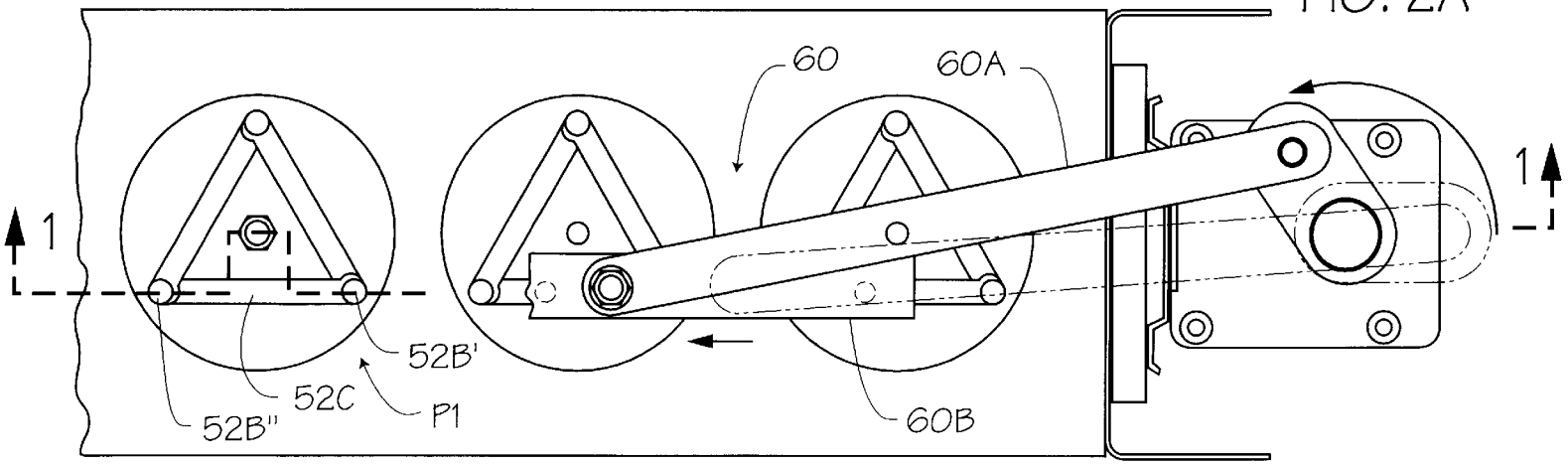
FIG. 2A is a top plan view thereof showing a drive arm of the invention moving in a forward stroke of reciprocating motion of the invention.
Figure 3:
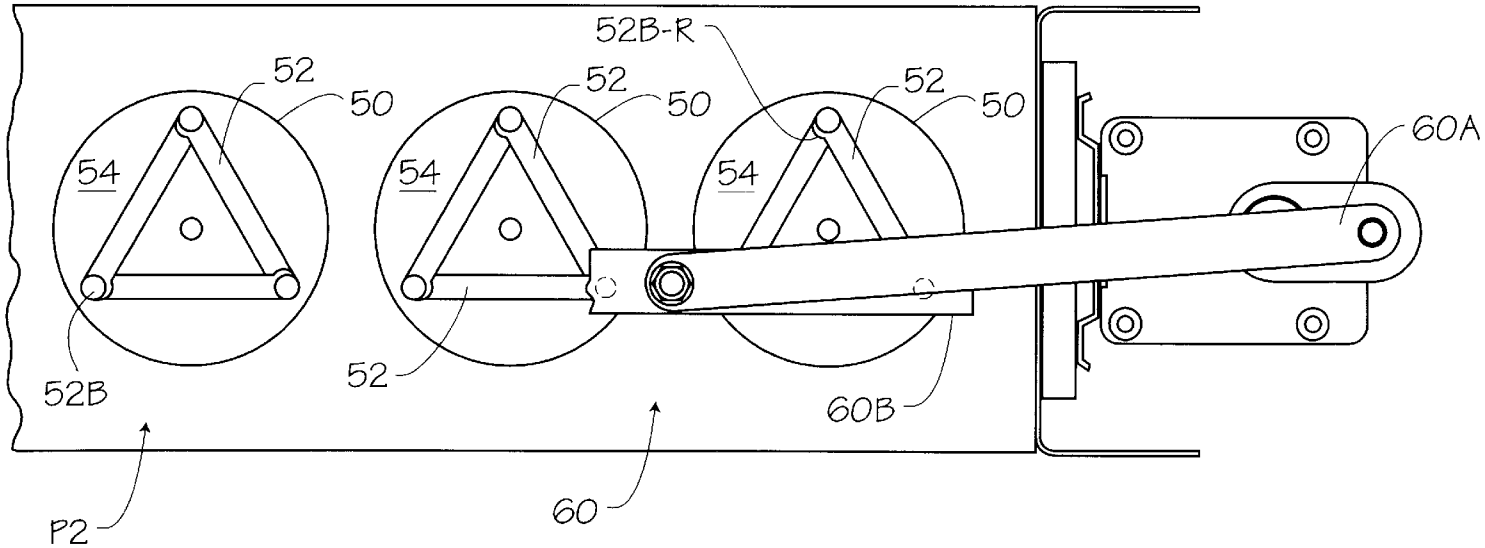
FIG. 3 is a top plan view thereof showing the position of drive arm and drive disks when the reciprocation cycle is complete.

The reciprocating motion comprises a forward stroke of the drive arm 60B, as shown in FIG. 2A, and a reverse stroke of the drive arm 60B, as shown in FIG. 2B, the grooves 52 and pin rest cutouts 52B being formed such that for each engagement pin 62 and drive disk 50 pair, on the forward stroke, the engagement pin 62 moves from one of the pin rest cutouts, 52B' in FIG. 2A, along one of the grooves 52, moving upward on the ramped surface 52C of the groove 52 and then dropping into a second one of the pin rest cutouts 52B" in FIG. 2A. To enable this, drive arm means 60 is able to accommodate vertical compliance. On the reverse stroke as shown in FIG. 2B, the pin 62 pulls on the drive disk 50 rotating it, as shown in FIG. 2B to the second rotational position P2, the pin 62 remaining within the second pin rest cutout 52B" during the reverse stroke, thereby completing one cycle of the sign drive. Each cycle rotates a new sign into view. Preferably three grooves 52 are arranged to form an equilateral triangle in each drive disk as shown in the figures, so that three different signs may displayed. In this case three cycles of reciprocation result in a single full rotation of the drive disks 50.

Figure 6:
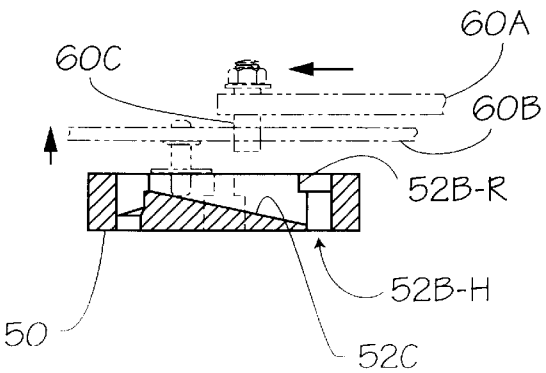
FIG. 6 is a sectional view taken along line 6—6 of FIG. 4 and showing the relative motion of an engagement pin of the invention with a drive disk.
Figure 5:
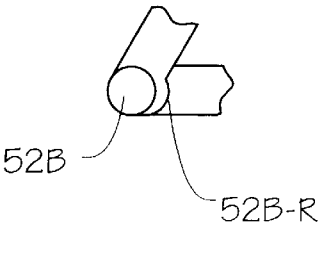
FIG. 5 is an enlarged view of a portion of FIG. 4 taken along line 5—5.
Figure 4:
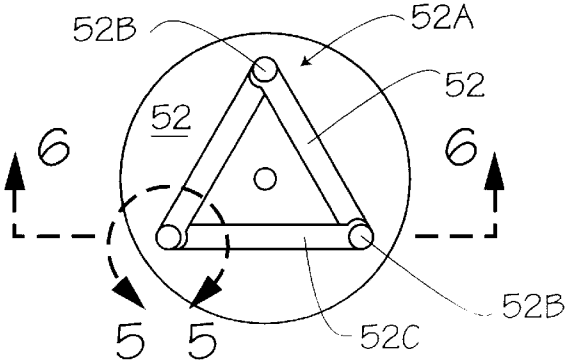
FIG. 4 is a top plan view of one of the drive disks of the invention.

Preferably, each of the pin rest cutouts 52B comprises a hole 52B–H with a pin rest ridge 52B–R positioned within the hole, as best seen in FIGS. 5 and 6, such that at the start of the reverse stroke the engagement pin 62 is urged by the pin rest ridge 52B–R to remain within the presently engaged pin rest cutout 52B.

The invention includes a switching means 70 for disabling the drive arm means 60 after each cycle of the reciprocating motion. Such a switching means 70 is illustrated in FIG. 1 whereby a single rotation of a motor driven shaft 72 moves a finger 74 fixed to the shaft 72 into contact with an electrical switch 76 to enable a power circuit (not shown) so as to disable a drive motor 78 until a timer cycle is completed whereupon the cycle repeats itself. The necessary circuitry for enabling this switching function is well known in the art so that further description here is not necessary to enable such by one of skill in the art.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A sign drive device comprising:

A plurality of side-by-side sign segments rotatably mounted on a fixed sign frame, each of the segments providing:

a plurality of sign sides arranged symmetrically and rotatable about a rotational axis for presenting each one of the sign sides, in turn, in a preferred direction;

a drive disk rigidly fixed at one end of the each of the segments so as to rotate therewith, the drive disks each providing a plurality of interconnected grooves in one surface of each of the drive disks, each of the grooves providing, at one end of said groove a pin rest cutout, the grooves each providing a ramped surface therein contiguous with the pin rest cutout;

a drive arm means extending in proximity to the drive disks, the arm means providing a plurality of engagement pins for moving with the drive arm, the pins engaging the grooves of the drive disks respectively, the pins moving in corresponding positions within the drive disks such that, for each engagement pin and corresponding drive disk, the pin lies within a corresponding one of the pin rest cutouts in the corresponding drive disk, motion of the drive arm means, causing the plurality of engagement pins to rotate the drive disks from a first rotational position whereby one of the sign sides of each of the segments respectively is presented in the preferred direction, to a second rotational position whereby another of the sign sides of each of the segments respectively is presented in the preferred direction for enabling the segments, together, to form a different composite image for each said motion of the drive arm means;

the grooves and pin rest cutouts being formed such that the engagement pin moves from one of the pin rest cutouts along one of the grooves moving upward on the ramped surface of the one of the grooves, thereupon dropping into a second one of the pin rest cutouts, the pin rotating the drive disk to the second rotational position, the pin remaining within the second pin rest cutout, thereby completing one cycle of the sign drive.

2. The device of claim 1 wherein each of the pin rest cutouts comprises a hole with a pin rest ridge positioned within the hole such that at the start of the reverse stroke the engagement pin is urged by the pin rest ridge to remain within a presently engaged pin rest cutout.

3. The device of claim 1 wherein each of the drive disks provides three said grooves arranged as an equilateral triangle.

4. The device of claim 1 further including a switching means for disabling the drive arm means after each cycle of the reciprocating motion.

5. The device of claim 1 further including a means for detent rotational location for frictionally engaging the drive disks at specified rotational positions.

* * * * *